US007982579B2

(12) United States Patent
Zama et al.

(10) Patent No.: US 7,982,579 B2
(45) Date of Patent: Jul. 19, 2011

(54) METAL FOIL RESISTOR

(75) Inventors: Matsuo Zama, Yurihonjo (JP); Toru Okamoto, Yurihonjo (JP)

(73) Assignee: Alpha Electronics Corporation, Tokyo (JP)

( * ) Notice: Subject to any disclaimer, the term of this patent is extended or adjusted under 35 U.S.C. 154(b) by 514 days.

(21) Appl. No.: 12/089,094

(22) PCT Filed: Oct. 2, 2006

(86) PCT No.: PCT/JP2006/319715

§ 371 (c)(1), (2), (4) Date: Apr. 3, 2008

(87) PCT Pub. No.: WO2007/040207

PCT Pub. Date: Apr. 12, 2007

(65) Prior Publication Data

US 2009/0267726 A1 Oct. 29, 2009

(30) Foreign Application Priority Data

Oct. 3, 2005 (JP) ..... 2005-290079

(51) Int. Cl.
*H01C 7/06* (2006.01)

(52) U.S. Cl. ..... 338/7; 338/53

(58) Field of Classification Search ..... 338/7, 50, 338/220, 53, 48, 325
See application file for complete search history.

(56) References Cited

U.S. PATENT DOCUMENTS

| | | | | |
|---|---|---|---|---|
| 5,486,682 | A * | 1/1996 | Rysemus | 219/544 |
| 5,859,581 | A * | 1/1999 | Morris | 338/50 |
| 6,747,543 | B2 * | 6/2004 | Lim | 338/50 |
| 6,892,443 | B2 | 5/2005 | Szwarc et al. | |
| 7,277,289 | B2 * | 10/2007 | Han | 361/707 |
| 2006/0108353 | A1 | 5/2006 | Catchpole | |

FOREIGN PATENT DOCUMENTS

| | | | |
|---|---|---|---|
| EP | 1 422 730 | A1 | 5/2004 |
| JP | 62-229801 | A | 10/1987 |
| JP | 1-21523 | Y2 | 6/1989 |
| JP | 5-60910 | U | 8/1993 |
| JP | 05-347201 | A | 12/1993 |
| JP | 9-134654 | A | 5/1997 |
| JP | 09-320805 | A | 12/1997 |
| JP | 10-241838 | A | 9/1998 |
| JP | 11-186009 | A | 7/1999 |
| JP | 2002-151304 | A | 5/2002 |
| JP | 2004-179639 | A | 6/2004 |
| JP | 2006-24933 | A | 1/2006 |
| JP | 2008-53591 | A | 3/2008 |

* cited by examiner

*Primary Examiner* — Kyung Lee

(74) *Attorney, Agent, or Firm* — Sughrue Mion, PLLC

(57) ABSTRACT

The metal foil resistor having a metal foil resistive element 20 composed of a metal foil whereupon a resistance circuit pattern is formed. The metal foil resistor comprises: a package 10 which contains the metal foil resistive element 20 in an electrically insulated state so that the resistive element can be expandable and contractible in a spreading direction of the metal foil; and a relay terminal 26 which is held in the package 10 in the electrically insulated state and is connected to an electrode 20*a* of the metal foil resistive element 20. A temperature coefficient of resistance can be reduced and stabilized. Control factors can be reduced to increase degrees in freedom in designing. Further, an external stress applied to a package is prevented from transmitting to the metal foil resistive element, and therefore the package can be easily attached to a discretionary heat sink.

12 Claims, 7 Drawing Sheets

【Fig. 1】
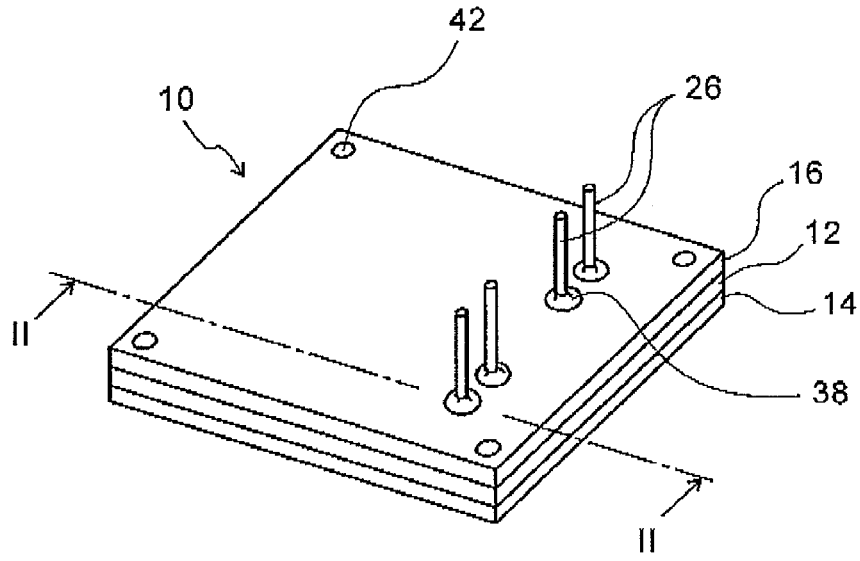
【Fig. 2】
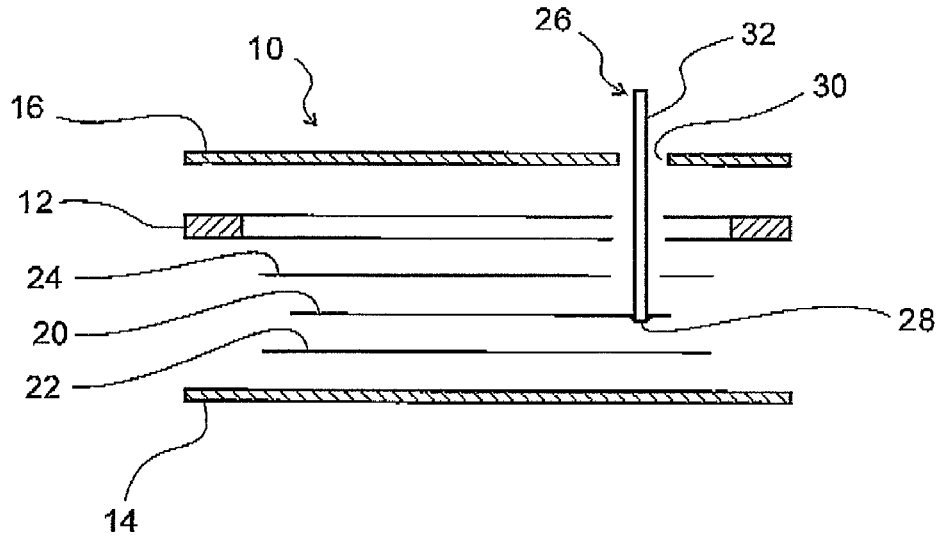

【Fig. 3】
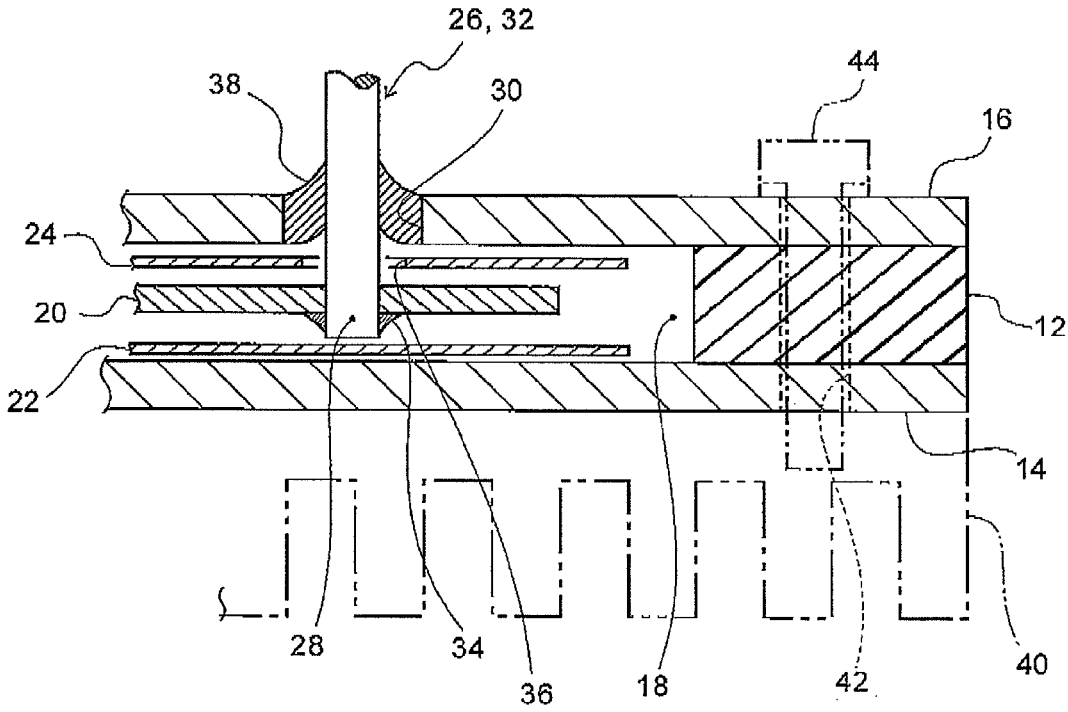

【Fig. 4】
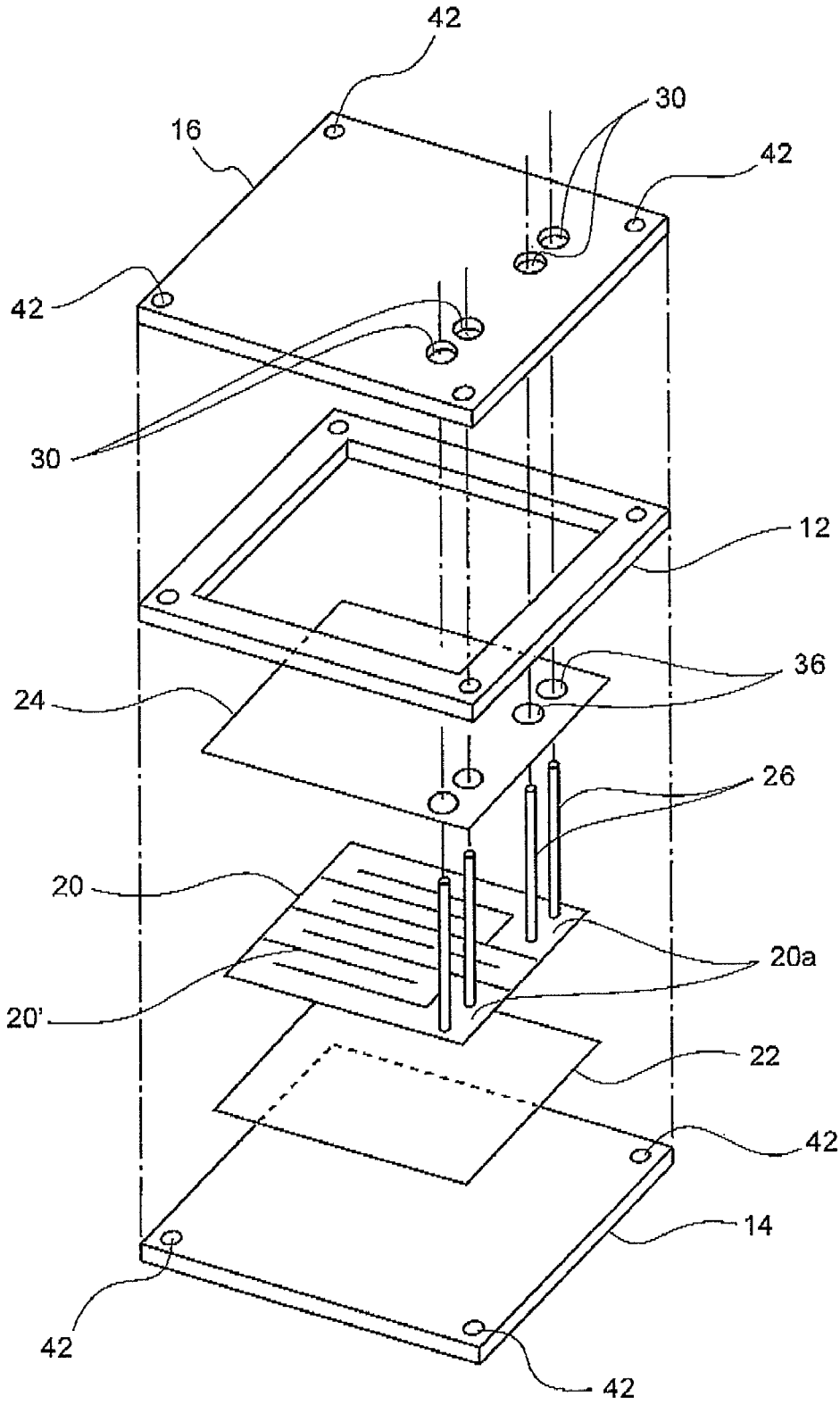

【Fig. 5】
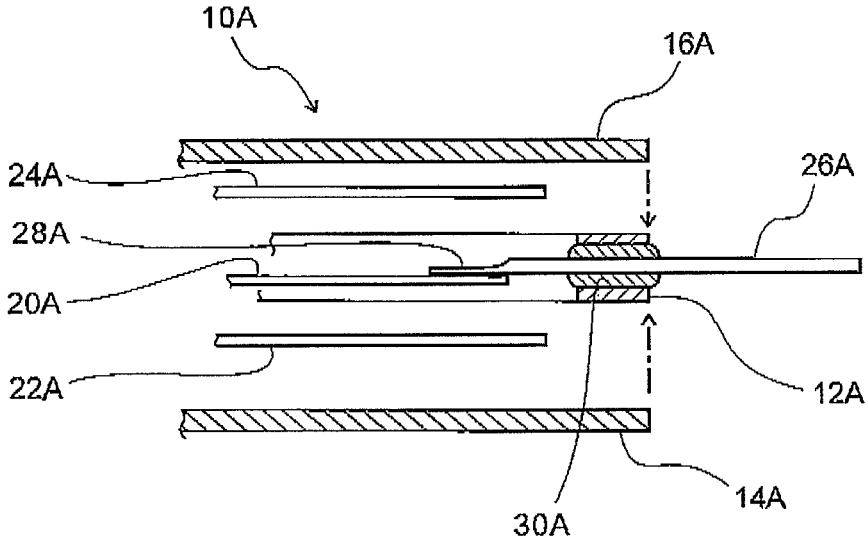
【Fig. 6】
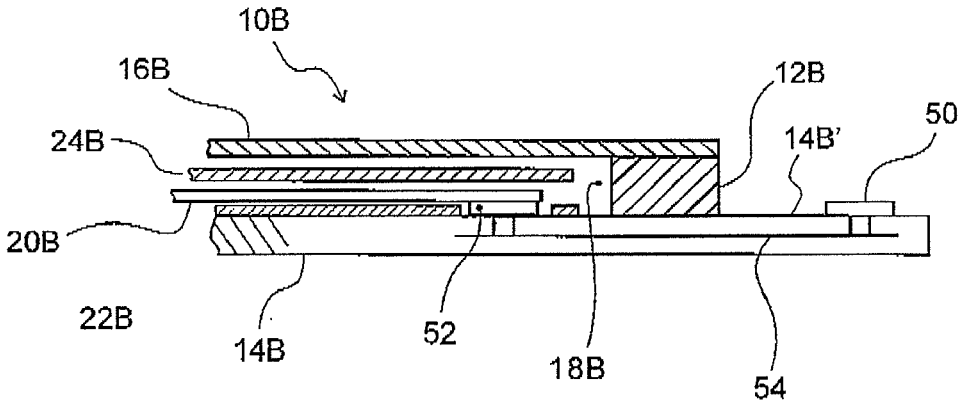

【Fig. 7】
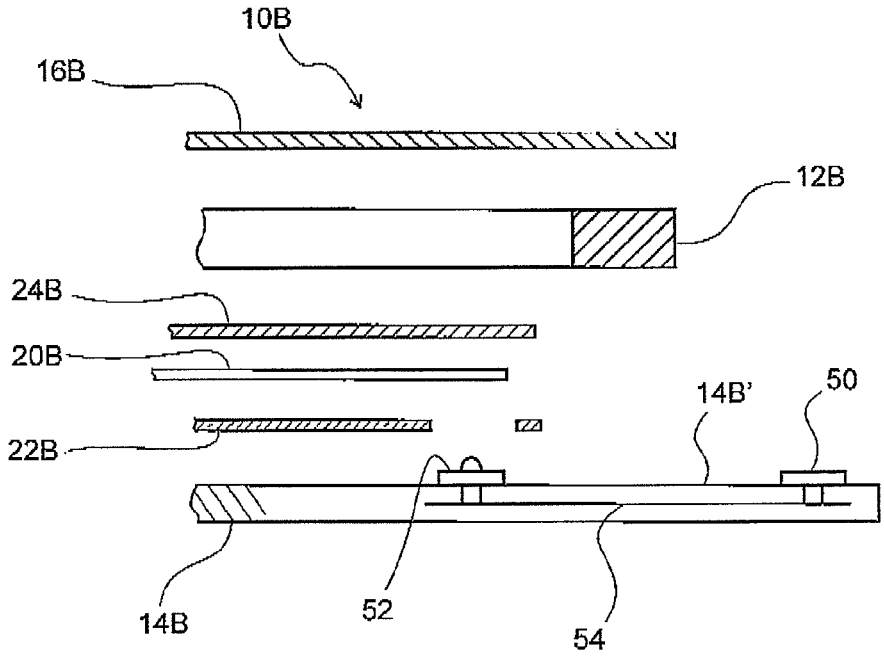
【Fig. 8】
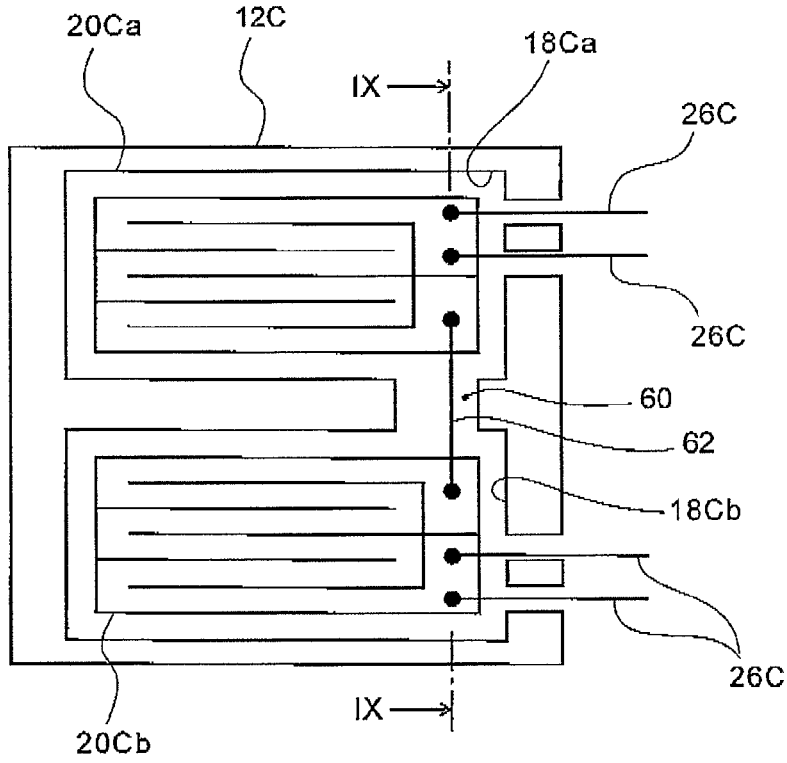

【Fig. 9】
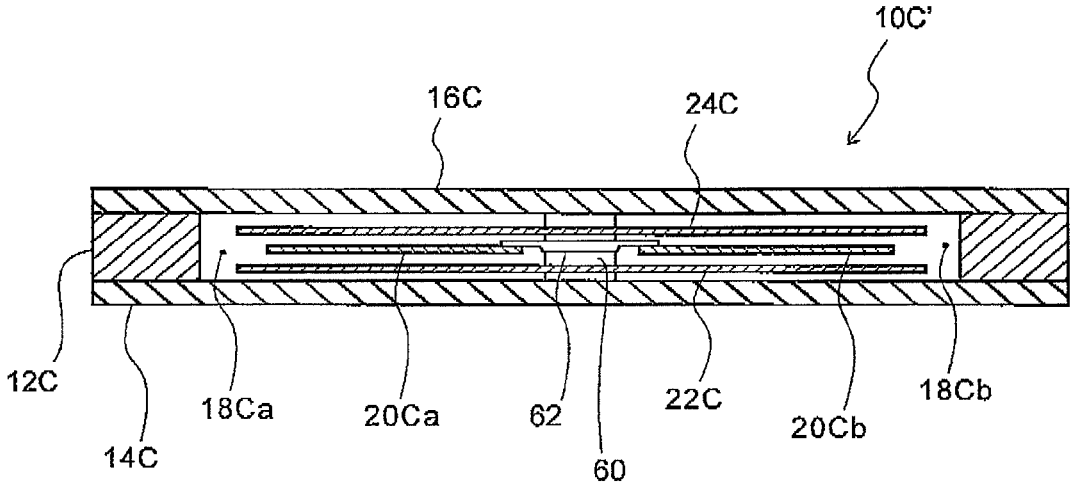

【Fig. 10】
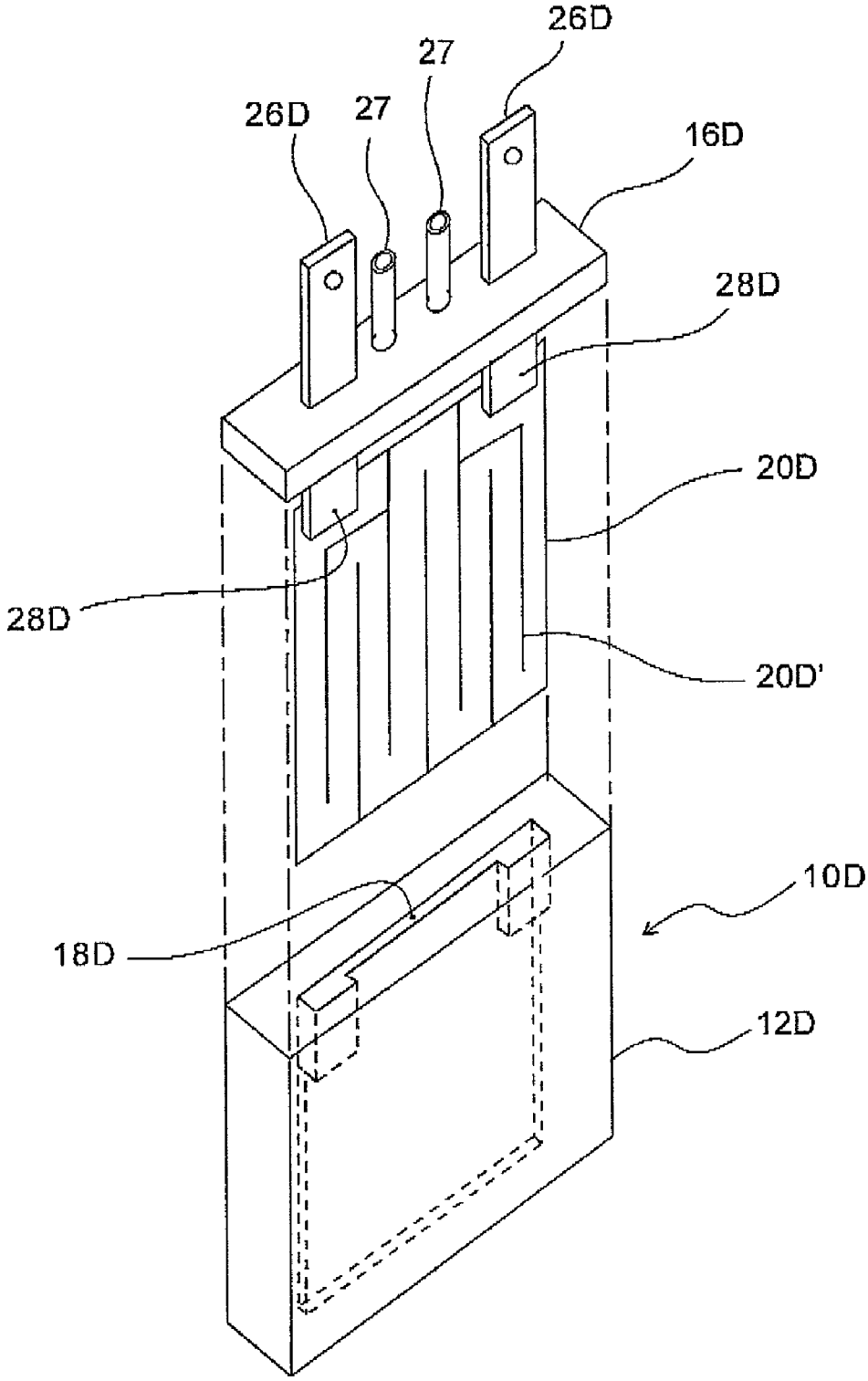

METAL FOIL RESISTOR

TECHNICAL FIELD

The present invention relates to a metal foil resistor in which a metal foil resistive element constituted of a metal foil provided with a resistance circuit pattern is encapsulated in a package, and an electrode of the metal foil resistive element is connected to an outer relay terminal.

BACKGROUND ART

There is known a metal foil resistor in which a resistance circuit pattern is formed in a metal foil attached to an insulating substrate with an adhesive, and this whole substrate is encapsulated with a resin coating. In this type of resistor, it is necessary to reduce a change of a resistance value with respect to a temperature change as much as possible, that is, reduce a temperature coefficient of resistance (hereinafter referred to as TCR).

An increase of the TCR is mainly due to the difference of the thermal expansion coefficient between the metal foil and the substrate to which the foil has been bonded or the difference of the thermal coefficient between the metal foil and an adhesive or cement for bonding the metal foil and the substrate. Due to the differential thermal expansion coefficients, a stress is applied to the metal foil by a change of an ambient temperature and self-heating of the metal foil resistor, and thereby the metal foil is strained or distorted. For example, a Ni-Cr metal foil and a ceramic substrate differ significantly in the thermal expansion coefficient. Therefore, it has heretofore been known that the resistance change due to the temperature change of the metal foil itself is used for compensating the influence of the strain or stress induced by the temperature change on the TCR so as to reduce the TCR.

More specifically, the TCR is reduced by appropriately setting a material, a thickness, a thermal treatment and the resistance circuit pattern of the metal foil, materials and thicknesses of the substrate and the adhesive (cement) or the like. In Japanese Patent Publication (KOKAI) No. 2004-179639 (corresponding to U.S. Pat. No. 6,892,443 and EP 14227301A1), there are described examples of set numeric values of such design elements (control factors).

DISCLOSURE OF THE INVENTION

Problems to be Solved by the Invention

In the conventional resistor, since the metal foil is bonded to the substrate in a sealed airtight package, there should be a difference of thermal expansion among the metal foil, the substrate and the adhesive, which causes the strain or stress to the metal foil. To reduce the TCR, many control factors (the materials and the thicknesses of the metal foil, the materials and the thicknesses of the substrate, the materials and the thicknesses of the adhesive, and a structure of a package, etc.) need to be strictly set, but it is remarkably difficult to strictly set them. Moreover, the TCR stability is seriously affected by characteristic change with time, such as temporal viscoelasticity change of the adhesive. Therefore, it is remarkably difficult to sufficiently reduce and stabilize the TCR in a broad temperature range.

On the other hand, the metal foil itself is usually an alloy, and the temperature coefficient of resistance of the metal foil alone, that is, the temperature coefficient of resistance in a free state in which any strains or stresses are not applied can sufficiently be reduced by adjustment of alloy compositions, applications of rolling process, thermal treatment, chemical or electrochemical etching process or the like.

The present invention has been developed in view of such a situation, and an object is to provide a metal foil resistor which is capable of reducing and stabilizing a TCR, reducing control factors to increase a degree of freedom in design, and preventing an external stress applied to a package from being transmitted to a metal foil resistive element to thereby facilitate attaching of the package to an appropriate heat sink.

Means for Solving the Problems

According to the present invention, this object is achieved by a metal foil resistor having a metal foil resistive element constituted of a metal foil in which a resistance circuit pattern is formed, the metal foil resistor comprising:

a package which contains the metal foil resistive element in an electrically insulated state so that the resistive element can be expandable and contractible in a spreading direction of the metal foil; and a relay terminal which is held in the package in an electrically insulated state and is connected to an electrode of the metal foil resistive element.

Effect of the Invention

The metal foil resistive element is contained in the package in the insulated state so as to be expandable and contractible in the extending direction (planar direction) of the metal foil. When the metal foil is positioned along the horizontal direction, geographic vertical direction and tilt direction of the package, the planner direction of the metal foil is along the horizontal, geographic vertical and tilt directions, respectively. The metal foil is not fixed on the substrate by an adhesive or cement. Therefore, even when the package temperature or metal foil temperature changes owing to the change of the ambient temperature or self-heating of the metal foil, the metal foil itself can freely expand and contract in its extending direction since any stresses are not induced and not applied to the metal foil. Any strain or distortion of the metal foil is prevented. With such arrangement, by using the metal foil having a sufficiently small TCR which can be achieved by appropriate alloy composition adjustment, rolling process, heat treatment and/or etching process, the TCR of the resistor can sufficiently be reduced and stabilized.

Moreover, unlike the conventional resistor unit, it is not necessary to consider the change of the TCR due to control factors such as the materials, the thicknesses and the structures of the substrate, the adhesive or cement, the package and the like. Therefore, the number of control factors are reduced, design is facilitated, and the degree of freedom of design increases.

Furthermore, the external stress to be applied to the package is not directly transmitted to the metal foil. Therefore, even when the package is fixed so as to come into close contact with the appropriate heat sink, the TCR might not be adversely affected.

BRIEF DESCRIPTION OF THE DRAWINGS

FIG. 1 is a perspective view of a standard resistor according to an embodiment of the present invention;

FIG. 2 is an exploded diagram cut along the II-II line of FIG. 1;

FIG. 3 is an enlarged sectional view cut along the II-II line of FIG. 1, showing the vicinity of a relay terminal;

FIG. 4 is an exploded perspective view of the whole standard resistor in the embodiment of FIG. 1;

FIG. 5 is an exploded enlarged sectional view of the vicinity of a relay terminal connecting portion of a standard resistor according to a second embodiment of the present invention;

FIG. 6 is a sectional view of the vicinity of a relay terminal connecting portion of a standard resistor according to a third embodiment of the present invention;

FIG. 7 is an exploded sectional view showing the vicinity of the relay terminal connecting portion in the third embodiment;

FIG. 8 is a plan view showing a resistor arrangement of a standard resistor according to a fourth embodiment of the present invention;

FIG. 9 is a sectional view cut along the IX-IX line of FIG. 8, and

FIG. 10 is an exploded perspective view showing a resistor arrangement of a standard resistor according to a fifth embodiment of the present invention.

EXPLANATION OF REFERENCE NUMERALS

10, 10A, 10B, 10C, 10D Package
12, 12A, 12B, 12C Quadrangular Frame
12D Block
14, 14A, 14B, 14C Bottom Cover
14, 16A, 16B, 16C, 16D Top Cover
18, 18A, 18B, 18Ca, 18Cb, 18D Resistor Accommodation Space
20, 20A, 20B, 20Ca, 20Cb, 20D Metal Foil Resistive Element
20*a* Electrode
22, 22A, 22B, 22C Insulator Film
24, 24A, 24B, 24C Insulator Film
26, 26A, 26C, 26D Relay Terminal
28, 28A, 28D Inner End
30 Relay Terminal Insertion Hole
32 Outer End
38 Sealant
40 Heat Sink (Cooling Block)
42 Mounting Hole
50, 52 Conductive Pad (Relay Terminal)
54 Inner Layered Circuit
60 Cutoff Portion
62 Connecting Wire

BEST MODE FOR CARRYING OUT THE INVENTION

The package may be made of an insulator material such as resin, ceramic or glass (Claim 2). In this case, the package may have a structure obtained by dividing the package along a splitting plane which passes through the resistor accommodating space. After placing the metal foil resistive element in the accommodation space, the package can be sealed by closing the splitting surfaces of the divided packages in an airtight manner. The package may be made of a metal (Claim 3). In this case, an inner surface of the resistor accommodation space may be insulated beforehand. This insulating treatment may be performed by, for example, applying an insulating paint or attaching an insulator film.

Moreover, the package is made of a metal, and then insulator films may be sandwiched between opposite surfaces of the metal foil resistive element and an inner surface of the package (the inner surface of the resistor accommodation space) (Claim 4). In this case, when the insulator film is allowed to move slightly freely between the metal foil resistive element and the package inner surface, the stress applied to the metal foil resistive element can further be reduced. This insulator film may be coated with or attached to a material, such as ceramic powder for increasing a sliding property of the surface of the film so that the film easily slides.

The inner space of the package (resistor accommodation space) may be filled with a thermally conductive liquid medium having an insulating property, for example, an insulating oil (Claim 5). The liquid medium can quickly transmit heat of the metal foil to the package to radiate heat to the outside, and a cooling property is enhanced. In the case that thermally conductive liquid medium has a specific gravity as same as that of the metal foil, the metal foil will be suspended in the liquid medium, resulting in that an influence of the gravity loaded to the metal foil can be prevented. The package made of a metal may further be coated with a resin, and protected (Claim 6).

The relay terminal is fixed to the package so that an inner end of the terminal is introduced through the package to enter the resistor accommodation space and an outer end thereof protrudes out of the package. Moreover, the electrode of the metal foil resistive element may be secured to the inner end of the relay terminal (Claim 7). When the package is made of the metal, the relay terminal is passed through a relay terminal insertion hole disposed in the package, and this insertion hole may be sealed with an insulating adhesive, sealing glass or the like. Preferably, the insertion hole may be sealed with a sealing material which can be absorb or block the transmission of the external stress from the package to the relay terminal or internal metal-foil resistor. Preferable examples of the sealing materials include an elastic sealant.

The inner end of the relay terminal may be soldered to the metal foil resistive element by use of, for example, a high-temperature solder. Preferable example of the metal foil is a resistance material such as an Ni-Cr alloy or a copper alloy which is formed into a foil and subjected to routine processing such as rolling process, thermal treatment or etching process. Needless to say, an appropriate bonding method may be employed depending on the material of the metal foil.

The relay terminal may be disposed along a substantially vertical direction with respect to the metal foil (Claim 8). Alternatively, the relay terminal may be disposed substantially in parallel with the metal foil. The package may contain one metal foil resistive element, but one package may contain a plurality of metal foil resistive elements having different characteristics, and a combination of the characteristics of these metal foil resistive elements can be utilized to improve the whole characteristics (Claim 9). For example, metal foil resistive elements having mutually reverse TCR characteristics can be combined to remarkably reduce the TCR of the whole resistor unit.

A mounting hole for use in fixing the package to a heat sink may be formed in the package (Claim 10). In the resistor unit of the present invention, even when the external stress is applied to the package, the characteristics of the resistor do not deteriorate. Therefore, the package can be fixed to the heat sink with a bolt by use of the mounting hole. Therefore, heat radiation performance can be improved. When the heat sink is managed to maintain at constant temperature, stability of the resistor unit can remarkably be enhanced. Same Effect will be obtained by bonding the package on the heat sink by an adhesive reagent.

The metal foil resistive element may be geographic vertically suspended and contained in the accommodation space of the package so that the electrode thereof is positioned upwardly and the metal foil itself is hung from the electrode (Claim 11). Such arrangement can significantly reduce the influence of the gravitational force exposed to the metal foil resistive element, resulting in the further improvement of the stability of the resistor characteristics.

First Embodiment

The present invention will be described hereinafter in detail in accordance with a standard resistor to which one embodiment of the present invention has been applied with reference to FIGS. 1 to 4.

In these figures, reference numeral 10 is a package made of a metal and constituted by superimposing a quadrangular frame 12 on a bottom cover 14 and a top cover 16 so that they are brought into close contact with each other and fixed. Accordingly, in the package 10, there is formed a flattened space having a height equal to a thickness of the frame 12, which serves as a resistor accommodation space or chamber 18 (FIG. 3).

This package 10 contains a metal foil resistive element 20 constituted of a metal foil in which a resistance circuit pattern is formed and which is electrically insulated from the package 10. In this embodiment, insulator films 22, 24 are superimposed on opposite surfaces of the metal foil resistive element 20, and installed in the resistor accommodation space 18. It is to be noted that the insulator films 22, 24 have shapes slightly smaller than an opening shape of the frame 12 so that the films 22, 24 fall in the frame 12, and the films have sufficiently wide area than that of the metal foil resistive element 20.

The metal foil resistive element 20 is prepared by simultaneously forming a large number of resistance circuit patterns (resistance elements) on the metal foil with keeping a connected state so as to prevent the circuit patterns from being separated, followed by cutting the individual circuit patterns (resistance elements) out of the metal foil. When the metal foil is thick, the opposite surfaces of the foil are coated with a photoresist. Thereafter, exposure and development are performed. The opposite surfaces are subjected to etching so that a large number of circuit patterns may simultaneously be formed. When the metal foil is thin, the foil is tentatively bonded to a substrate beforehand. After a large number of circuit patterns are simultaneously formed by the etching, an adhesive force of an adhesive is removed by a solvent or heat, and the individual circuit patterns may be cut out for use.

When a width of a slit 20' between resistance areas of the individual circuit patterns (resistive elements) is increased with a decrease of a foil thickness, the resistance areas of the resister foil can be prevented from being overlapped on each other. When the foil thickness is large, rigidity of the resistance area also becomes large. Therefore, the resistance areas of the foil do not come into contact with each other or are not overlapped on each other. It is preferable to mount each cutout circuit pattern on a board and handle it. In this case, the metal foil of the circuit pattern (resistive element) is sometimes warped owing to its weight. However, when any large load is not applied to the circuit pattern (resistive element) to such a degree as to plastically deform the pattern, the pattern returns to its original state, and a function of the pattern is not impaired.

Alternatively, the metal foil in which the circuit pattern is formed may be fixed to the insulator film to prevent the adjacent resistance areas from being overlapped on each other or brought into contact with each other. Preferably, the insulator film for use in this case has a flexibility to such an extent that expansion and contraction of the metal foil are not inhibited and any stress is not applied to the foil. One of the insulator films 22, 24 may have such a flexibility.

Reference numerals 26 are rod-like relay terminals, an inner end 28 of each terminal extends through a relay terminal insertion hole 30 disposed in the top cover 16 to enter the resistor accommodation space 18, and an outer end 32 thereof protrudes out of the insertion hole 30. The inner ends 28 is secured to electrodes 20*a* of the metal foil resistor 20 (see FIG. 4). That is, each inner end 28 penetrates through the electrode 20*a*, and is fixed to the electrode with a high-temperature solder 34. In addition, the insulator film 22 is interposed between the inner end 28 and the bottom cover 14, and the inner end 28 and the resistor 20 are electrically insulated from the bottom cover 14. A dent may be disposed in a position of the bottom cover 14 facing this inner end 28 so that the insulator film 22 is prevented from being damaged by stacking between the inner end 28 and the bottom cover 14.

The upper insulator film 24 is provided with small holes 36, through which the relay terminals 26 are to extend (FIG. 4). The relay terminals 26 pass through the small holes 36 and the insertion holes 30 to protrude outwardly. After assembling the package 10, each insertion hole 30 is sealed with a sealant 38 such as a resin or sealing glass in an airtight manner.

To manufacture this resistor unit, first the bottom cover 14 is fixedly brought into close contact with the frame 12 to form the upwardly open resistor accommodation space 18 in the frame 12. The insulator film 22 is disposed in the accommodation space 18, and the metal foil resistive element 20 to which the relay terminals 26 have been secured beforehand is mounted on the insulator film. Moreover, the upper insulator film 24 is superimposed, and the top cover 16 is fixedly brought into close contact with the frame 12. The atmosphere in the resistor accommodation space 18 is set to be constant to seal the relay terminal insertion holes 30 with the sealant 38.

Along with sealing process of the relay terminal insertion holes 30, dry air or inactive gas may be introduced in the resistor accommodation space 18, or the accommodation space 18 may be filled with an insulating oil. Alternatively, a sealable through hole (not shown) may be disposed separately from the relay terminal insertion holes 30. After sealing the relay terminal insertion holes 30 with the sealant 38, the atmosphere in the accommodation space 18 may be managed to be constant by use of this through hole.

In this embodiment, two relay terminals 26 are secured to each of two electrodes 20*a*, 20*a* of the resistive element 20, thereby a four-terminal structure is formed. Therefore, four relay terminal insertion holes 30 are formed in the top cover 16, and four small holes 36 are formed in the upper insulator film 24. It is necessary to prevent an error due to a wiring resistance between the terminal and the metal foil resistor in the standard resistor having a small resistance value (e.g., 1Ω or less). In the embodiment, accordingly, voltage terminals are disposed separately from current terminals.

According to this resistor, the resistive element 20 is expandably/contractibly held in the resistor accommodation space 18 in a so-called free state. Therefore, even if the resistive element 20 expands or contracts or the package 10 strains owing to a change of an ambient temperature or heat generation of the resistive element 20 itself, any stress (strain stress) due to this expansion/contraction or the strain is not applied to the resistive element 20. In addition, the TCR of the metal foil alone can remarkably be reduced in accordance with the material or the processing treatment. Therefore, the TCR of the metal foil resistive 20 can be appropriately managed. When such resistor is encapsulated in the package 10, the TCR of the whole resistor unit can sufficiently be reduced and stabilized.

On four corners of this package 10, mounting holes 42 for use in attaching the package 10 to a heat sink 40 are formed (FIG. 3). Bolts 44 are secured in the mounting holes 42 and fastened to fix the package 10 to the heat sink 40. In this case, strain is generated in the package 10, but any stress due to this strain is not transmitted to the resistor 20. Therefore, the package 10 is easily attached and fixed. As preferable heat sink 40, there may be used a heat transfer block provided with an air cooling fin, a cooling block having a coolant passage, or another member having a heat transfer property, such as a chassis to which a circuit substrate is to be attached or a container case.

Second Embodiment

FIG. 5 is an exploded enlarged sectional view of the vicinity of a relay terminal connecting portion in another embodiment. In this embodiment, a relay terminal insertion hole 30A is formed in a frame 12A of a package 10A in a horizontal direction (direction perpendicular to a thickness direction). After a relay terminal 26A is passed through the insertion hole 30A, the insertion hole 30A is sealed with a resin or glass. A flat inner end 28A of the relay terminal 26A is superimposed on and connected to an electrode of a metal foil resistor 20A.

This resistive element 20A and the inner end 28A are sandwiched between the insulator films 22A and 24A, and a bottom cover 14A and a top cover 16A are overlaid on the frame 12A to hermetically seal the resistive element 20A and the inner end 28A.

Third Embodiment

FIG. 6 is a sectional view of the vicinity of a relay terminal connecting portion in still another embodiment, and FIG. 7 is an exploded view of FIG. 6. In a package 10B of this embodiment, one end 14B' of a bottom cover 14B is protruded outwardly from a frame 12B. And conductive pads 50, 52 are formed on the surface of the protruded portion 14B' and in a resistor accommodation space 18B positioned inside of the frame 12B, respectively. These pads 50, 52 are connected to each other by an inner layered circuit 54 of the bottom cover 14B. The conductive pads 50, 52 and the inner layered circuit 54 can be prepared in a technique similar to that of a known printed wiring board.

A metal foil resistive element 20B is soldered to the conductive pad 52. In this soldering, for example, solder plating, solder ball, solder paste or the like may be supplied to the surface of the conductive pad 52 beforehand, and an electrode of the resistive element 20B may be pressed and heated on the surface to reflow-solder the resistor.

Fourth Embodiment

FIG. 8 is a plan view showing a resistor arrangement in a further embodiment, and a top cover and an upper insulator film are omitted from the view. FIG. 9 is a sectional view cut along the IX-IX line of FIG. 8. In this embodiment, one package 10C contains two different metal foil resistive elements 20Ca, 20Cb, and both resistive elements are connected to each other in series. Here, the resistive elements 20Ca, 20Cb have different temperature characteristics. For example, one resistive element indicating a positive TCR is combined with the other resistive element indicating a negative TCR. When an absolute value of one TCR is substantially equal to that of the other TCR in a predetermined temperature range, the sum of both the TCR is almost 0 (zero), and the TCR of the whole resistor unit can remarkably be reduced.

The inside of the package 10C is partitioned into two resistor accommodation spaces 18Ca, 18Cb, and a partition wall between the accommodation spaces 18Ca and 18Cb is partly cutoff. A connecting wire 62 passes through the cutoff portion 60 to connect the resistive elements 20Ca, 20Cb. Further, upper and lower insulator films 22C, 24C between which the resistive elements 20Ca, 20Cb are sandwiched are integrally connected to each other by connecting portions extending through the cutoff portion 60. The upper and lower connecting portions sandwiches the wire 62 therebetween, the wire extending through the cut portion 60, and the wire 62 is insulated from the package 10C.

In the same manner as in the embodiment of FIG. 5, relay terminals 26C horizontally extend through a frame 12C, and are sealed in an airtight manner. It is to be noted that 14C, 16C are a bottom cover and a top cover.

Fifth Embodiment

FIG. 10 is an exploded perspective view showing a fifth embodiment according to the present invention. In the fifth embodiment, a package 10D made of resin comprises a vertically long block 12D and a top cover 16D. The block 12D includes a narrow slot 18D having an opening in the upper side. The narrow slot 18D serves as a resistor accommodation space or chamber of the present invention. The accommodation chamber 18D is airtightly sealed with the top cover 16D which is cemented to the upper face of the block 12D with no air gap.

Plate-like relay terminals 26D, 26D pass vertically through the top cover 16D and inner ends 28D, 28D of the terminal 26D, 26D penetrate and protrude into the resistor accommodation chamber 18D. Electrodes of the metal foil resistive element 20D are fixed to the inner ends 28D, 28D of the relay terminals with a solder or the like. That is, the metal foil resistive element 20D is vertically hung from the inner ends 28D, 28D of the relay terminals 26D, 26D.

A slit 20D' is formed in the metal foil resistive element 20D for dividing resistance areas of the individual circuit pattern. Therefore, it is conceivable that the width of slit 20D' or gap size between the resistance areas is fluctuated when the metal foil resistive element 20D is vertically accommodated in the chamber 18D. This causes a distortion or bending of some portion of the metal foil resistive element 20D. However, this problem can be avoided by an appropriate resistor arrangement such as the thickness of the metal foil, the width, direction and length of the circuit pattern, the slit width, the direction (vertical, oblique or horizontal) and length of the slit 20D'. For example, the thickness of the metal foil may be 25 μm or more, the width of resistance area of the circuit pattern may be 1 mm or more and the length of the metal foil in the vertical direction may be 30 mm or less.

The metal foil resistive element 20D suspended from the inner ends 28D, 28D of the relay terminals 26D, 26D is inserted into the resistor accommodation space 18D, when the top cover 16D is bonded to be fixed to the top face of the block 12D. The package 10D is formed of an electrically insulating resin having high heat conductivity and heat resistance property. Therefore, any insulating films are not required to be inserted between the metal foil resistive element 20D and an inner surface of the accommodation chamber 18D.

Two metallic pipes 27, 27 pass through the top cover 16D. These pipes 27, 27 are used for filling an insulating oil into the resistor accommodation chamber 18D which has contained the metal foil resistive element 20D. More specifically, the insulating oil is introduced into the chamber 18D through either pipe 27 and air is discharged through the other pipe 27. After filling of the insulating oil into the chamber 18D, the pipes are sealed by caulking or with a sealant. The insulating oil used herein quickly releases the heat generated in the resistive element 20D to the package 10D, thereby the temperature of the resistive element 20D is stabilized. Also, the insulating oil prevents irregular movement of the resistive element 20D in the chamber 18D. Preferably, the insulating oil has an electrical insulating property and superior heat conductivity. Meanwhile, the package 10D may be provided with mounting holes for attaching the package 10D to an external heat sink.

According to the fifth embodiment, the metal foil resistive element 20D is vertically disposed. Therefore, the stress or strain is less induced by the gravity on the metal foil resistive element, resulting to significantly reduce the gravitational influence against the resistor characteristics. In addition, the block 12D and the top cover 16D is formed by resin molding. Therefore, the resistor accommodation space or chamber 18D can be easily formed as significantly narrow slot, and the radiation performance of the resistive element 20D to the package 10D can be improved. Further, the relay terminals 26D, 26D and the pipe 27, 27 can be provided on the top cover 16D by insert molding process. This realizes a simple sealing structure of the relay terminals 26D, 26D and the pipes 27, 27. Even when the outside mechanical stress is applied to the relay terminals 26D, 26D, the stress is less likely to transmit to the resistive element 20D.

Moreover, the metal foil resistive element or 20D is introduced into the resistor accommodation chamber 18D so that the resistive element 20D is suspended from the relay terminals 26D, 26D. And then the block 12D is sealingly closed with the top cover 16D. Thus, the preparation of the metal foil resistor can be simplified. Further, although the top cover 16D can be simply bonded to the block 12D with the adhesive or cement, other method can be adopted. Even when the top cover 16D is secured by threadably mounting or other method, any external stresses do not transmit to the internal metal foil resistive element 20D. The characteristics of the resistive element 20D is not affected by the external stress.

The invention claimed is:

1. A metal foil resistor having a metal foil resistive element constituted of a metal foil in which a resistance circuit pattern is formed, the metal foil resistor comprising:

a package which contains the metal foil resistive element in electrically insulated state so that the resistive element can be expandable and contractible in a spreading direction of the metal foil; and a relay terminal which is held in the package in an electrically insulated state and is connected to an electrode of the metal foil resistive element;

wherein the relay terminal is held in the package so that an inner end of the relay terminal extends through the package to enter an accommodation space for accommodating the resistive element and an outer end of the relay terminal protrudes out of the package, and the electrode of the metal foil resistive element is secured to the inner end of the relay terminal.

2. The metal foil resistor according to claim 1, wherein the package is made of an insulator material.

3. The metal foil resistor according to claim 1, wherein the package is made of a metal, and an inner surface of a resistor accommodation space which contains the metal foil resistive element is insulated.

4. The metal foil resistor according to claim 1, wherein the package is made of a metal, and an insulator film is sandwiched between an inner surface of a resistor accommodation space which contains the metal foil resistive element and the surface of the metal foil resistive element.

5. The metal foil resistor according to claim 1, wherein a resistor accommodation space of the package which contains the metal foil resistive element is filled with a thermally conductive medium having an insulating property.

6. The metal foil resistor according to claim 1, wherein the package is made of a metal, and the package is encapsulated with a resin coating.

7. The metal foil resistor according to claim 1, wherein the relay terminal extends through the package in a substantially vertical direction with respect to the metal foil resistive element.

8. The metal foil resistor according to claim 1, wherein a plurality of metal foil resistive elements having different temperature coefficients of resistances are contained in a common package, and these metal foil resistive elements are combined to reduce the resultant temperature coefficient of resistance.

9. The metal foil resistor according to claim 1, wherein a mounting hole for fixing the package to a heat sink is formed in the package.

10. The metal foil resistor according to claim 1, wherein said metal foil resistive element is vertically contained in an accommodation space of the package so that the electrode of the metal foil resistive element is positioned upwardly and the metal foil itself is hung from the electrode.

11. A metal foil resistor having a metal foil resistive element constituted of a metal foil in which a resistance circuit pattern is formed, the metal form resistor comprising:

a package which contains the metal foil resistive element in electrically insulated state so that the resistive element can be expandable and contractible in a spreading direction of the metal foil;

a relay terminal which is held in the package in an electrically insulated state and is connected to an electrode of the metal foil resistive element; and a resistor accommodating space formed in the package, the resistor accommodating space containing the metal foil resistive element;

wherein an air gap is disposed between the metal resistive element and a side of the package in a direction perpendicular to a plane that is parallel to the metal foil resistive element.

12. A metal foil resistor having a metal foil resistive element constituted of a meal foil in which a resistance circuit pattern is formed, the metal foil resistor comprising:

a package which contains the metal foil resistive element in electrically insulated state so that the resistive element can be expandable and contractible in a spreading direction of the metal foil;

a relay terminal which is held in the package in an electrically insulated state and is connected to an electrode of the metal foil resistive element; and a resistor accommodating space formed in the package, the resistor accommodating space containing the metal foil resistive element, wherein a thermally conductive liquid is disposed between the metal resistive element and a side of the package in a direction perpendicular to a plane that is parallel to the metal foil resistive element.

* * * * *